US011493883B2

(12) United States Patent
Buehler et al.

(10) Patent No.: US 11,493,883 B2
(45) Date of Patent: Nov. 8, 2022

(54) TIMEPIECE DRIVE MECHANISM

(71) Applicant: Harry Winston SA, Plan-les-Ouates (CH)

(72) Inventors: Johnny Buehler, Luins (CH); Emmanuel Bouchet, Saint Antoine (FR)

(73) Assignee: Harry Winston SA, Plan-les-Ouates (CH)

( * ) Notice: Subject to any disclaimer, the term of this patent is extended or adjusted under 35 U.S.C. 154(b) by 821 days.

(21) Appl. No.: 16/435,607

(22) Filed: Jun. 10, 2019

(65) Prior Publication Data

US 2020/0033806 A1 Jan. 30, 2020

(30) Foreign Application Priority Data

Jul. 24, 2018 (EP) ..... 18185166

(51) Int. Cl.
*G04B 17/28* (2006.01)
*G04B 7/00* (2006.01)
*G04B 15/02* (2006.01)

(52) U.S. Cl.
CPC ..... *G04B 17/285* (2013.01); *G04B 7/00* (2013.01); *G04B 15/02* (2013.01)

(58) Field of Classification Search
CPC ..... G04B 17/285; G04B 15/02; G04B 7/00; G04B 17/20
See application file for complete search history.

(56) References Cited

U.S. PATENT DOCUMENTS 10,281,878 B2 * 5/2019 Breuilh ..... G04B 19/042
10,481,557 B2 * 11/2019 Mutrux ..... G04B 17/285
2013/0176827 A1 * 7/2013 Zaugg ..... G04B 19/268 368/15

(Continued)

FOREIGN PATENT DOCUMENTS

CH 705 938 A1 6/2013
CH 709 331 A2 9/2015

(Continued)

OTHER PUBLICATIONS

Combined Chinese Office Action and Search Report dated Dec. 24, 2020 in Chinese Patent Application No. 201910672670.0, 6 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece drive mechanism including a structure on which pivots an arm subjected to the return torque of a first energy source, this arm carrying a planetary gear including a wheel, a second energy source subjecting to a return torque a third wheel set on which the wheel rolls, under the action of the first energy source, the structure carries a stop device cooperating with complementary a stop device of the third wheel set to hold the latter in position, which are uncouplable under the action of uncoupling control device of the arm at the end of the forward angular travel of the arm to allow the third wheel set to pivot in a single direction under the action of the second energy source, causing a backward rotation of the arm to its start-of-angular-travel position.

23 Claims, 4 Drawing Sheets

(56) References Cited

U.S. PATENT DOCUMENTS

| | | | | |
|---|---|---|---|---|
| 2014/0126338 | A1* | 5/2014 | Forsey | G04B 17/285<br>368/127 |
| 2016/0231708 | A1* | 8/2016 | Roth | G04B 13/008 |

FOREIGN PATENT DOCUMENTS

| | | | |
|---|---|---|---|
| CH | 712 129 | A2 | 8/2017 |
| CN | 103038711 | A | 4/2013 |
| CN | 104914707 | A | 9/2015 |
| CN | 106483818 | A | 3/2017 |
| CN | 108693759 | A | 10/2018 |
| EP | 2 177 959 | A1 | 4/2010 |
| EP | 3 193 216 | A1 | 7/2017 |

OTHER PUBLICATIONS

Indian Office Action dated May 24, 2021 in Indian Patent Application No. 201944028710, 6 pages.
European Search Report dated Jan. 18, 2019 in European Application 18185166.8, filed on Jul. 24, 2018 (with English Translation of Categories of Cited Documents).
Office Action dated Jul. 28, 2020 in corresponding Japanese Patent Application No. 2019-114360 (with English Translation), 5 pages.

* cited by examiner

TIMEPIECE DRIVE MECHANISM

CROSS-REFERENCE TO RELATED APPLICATION

This application claims priority to European Patent Application No. 18185166.8 filed on Jul. 24, 2018, the entire disclosure of which is hereby incorporated herein by reference.

FIELD OF THE INVENTION

The invention concerns a timepiece drive mechanism, comprising a structure on which is pivotally mounted, about a main axis, an arm carrying a first mechanism, which is pivotally mounted on said arm about a first pivot axis remote from said main axis and includes a first wheel pivotally mounted about said first pivot axis or a pivot axis that is parallel thereto, said arm being subjected to the return torque of a first energy source, said drive mechanism further including at least a second energy source arranged to subject to a return torque a third wheel set comprised in said drive mechanism, directly, or indirectly via a second wheel set pivotally mounted about a second pivot axis.

The invention concerns the field of timepiece drive mechanisms and the field of timepiece display mechanisms.

BACKGROUND OF THE INVENTION

Lovers of watch complications are appreciative of some animation or movement in the displays of a timepiece, which can be provided by retrograde display mechanisms, or tourbillon or similar mechanisms, which moreover ensure less sensitivity to position.

Splitting the displays is also appreciated and offers the dial or mechanism a new look.

Retrograde displays are generally limited to the driving of hands, or more rarely of discs.

It has never been possible to achieve retrograde driving of a tourbillon or karussel cage, since a cage cannot go backwards on its fixed wheel and always has to rotate in the same direction. If an uncoupling system, using a cam or similar, is added in order to move the cage backwards, operation ceases during the backward motion, which is unacceptable.

CH Patent Application No. 709331A2 in the name of SEIKO INSTR. discloses a display mechanism which includes a cage unit including an escapement and a governor, and an operating unit configured to differentiate between the speed of motion of the cage unit with the passage of time and to move the cage unit in the direction toward or away from a first axis which is the centre of a particular display area, wherein the operating unit moves the cage unit such that the trajectory of movement, reproduced when the cage unit is moved in the direction toward the first axis which is the centre of the particular display area, is in continuity with the trajectory of movement reproduced when the cage unit moves in the direction away from the first axis which is the centre of the particular display area.

CH Patent Application No. 705938A1 in the name of ULYSSE NARDIN discloses a planetary gear train for timepieces for transferring energy from the input of the planetary train to the output of the planetary train, the train including:

- a first wheel having a first axis of rotation;
- a first planetary wheel, having a second axis of rotation parallel to the first axis of rotation, and arranged to cooperate with the first wheel;

- a second planetary wheel, having the second axis of rotation, and integral with the first planetary wheel;
- a fourth wheel having the first axis of rotation, and arranged to cooperate with the second planetary wheel; and
- a frame having the first axis of rotation, the frame connecting the first axis of rotation and the second axis of rotation such that the first planetary wheel and the second planetary wheel are carried by the frame, wherein the first planetary wheel and the second planetary wheel are arranged to rotate about the first axis of rotation in the state wherein the frame can rotate about the first axis of rotation, and wherein the frame is arranged to be mechanically connected, either directly or indirectly, to a first component of the timepiece, and the first wheel or the fourth wheel is arranged to be mechanically connected, either directly or indirectly, to a second component of the timepiece.

SUMMARY OF THE INVENTION

The invention proposes to develop a retrograde drive mechanism which is capable of carrying wheel sets having much higher inertia than the hands, particularly tourbillons or similar, and consequently to propose entirely novel displays.

To this end, the invention concerns a drive mechanism according to claim 1.

The invention also concerns a timepiece comprising at least one such drive mechanism.

BRIEF DESCRIPTION OF THE DRAWINGS

Other features and advantages of the invention will appear upon reading the following detailed description, with reference to the annexed drawings, in which:

FIG. 9 is a side view of this mechanism.

DETAILED DESCRIPTION OF PREFERRED EMBODIMENTS

Figure 1:
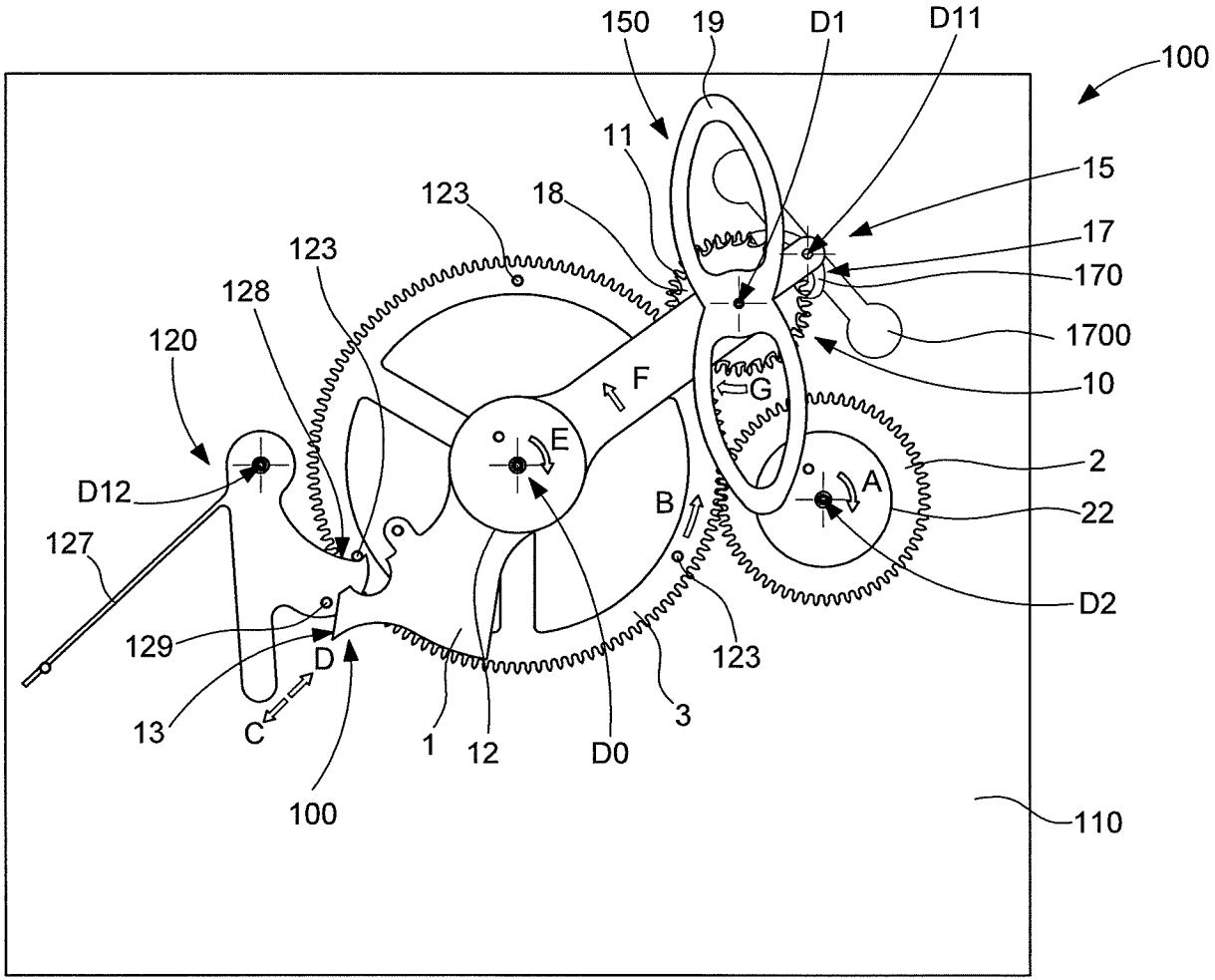
FIG. 1 represents a schematic, plan view of a mechanism according to the invention.

The invention concerns a timepiece drive mechanism 100, which has the advantage of being able to be used in a watch or in a static timepiece, with novel functionalities.

This drive mechanism 100 includes a structure 110, such as a plate, bridge or similar, on which is mounted an arm 1 pivoting about a main axis D0. This arm 1 carries a first mechanism which forms a planetary gear 10, which is pivotally mounted on arm 1 about a first pivot axis D1, which is remote from main axis D0. This planetary gear includes a first wheel 11, which is pivotally mounted about first pivot axis D1 or a secondary pivot axis D11 which is parallel thereto.

Arm 1 is subjected to the return torque of a first energy source 12, such as a barrel, a weight system, or otherwise.

Drive mechanism 100 further includes at least a second energy source 22, which is arranged to subject to a return torque a third wheel set 3 comprised in drive mechanism 100, directly or indirectly via a second wheel set 2 pivotally mounted about a second pivot axis D2, as in the particular and non-limiting variant illustrated by the Figures.

This second energy source 22 is the main energy source, and it is arranged to store more energy than first energy source 12.

According to the invention, first wheel 11 is arranged to roll over third wheel set 3 in a regularly advancing rolling motion, under the action of the return torque of first energy source 12.

Planetary gear 10 forms, therefore, a planetary wheel set, which moves in rotation about third wheel set 3, about main axis D0, always in the same direction, along arrow G (clockwise in FIG. 1), and at a constant speed.

Figure 2:
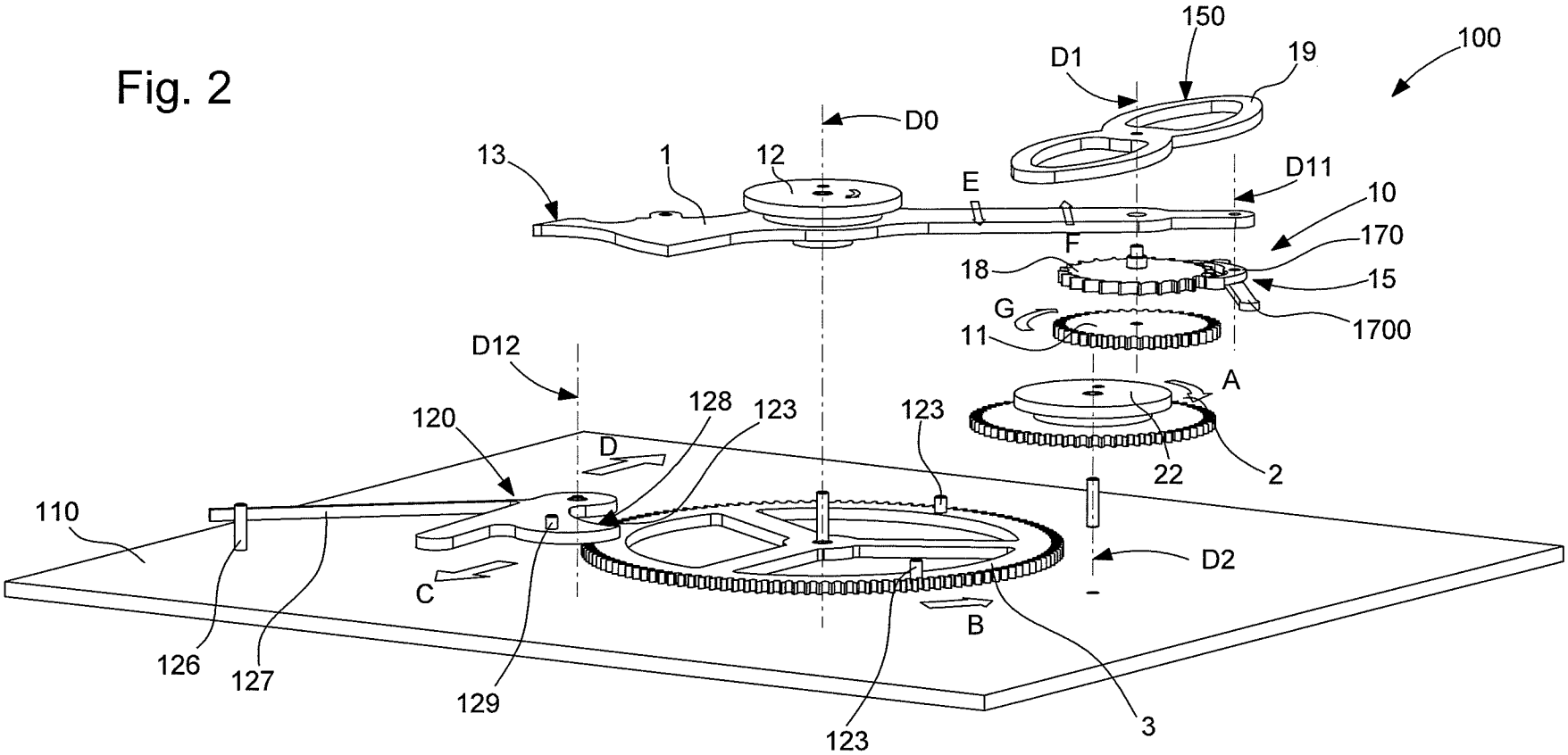
FIG. 2 represents a schematic, perspective, exploded view of the mechanism of FIG. 1.
Figure 3:
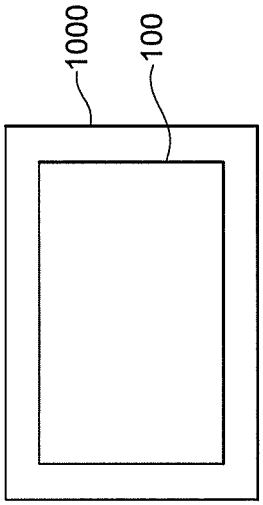
FIG. 3 is a block diagram representing a timepiece including such a mechanism.
Figure 4:
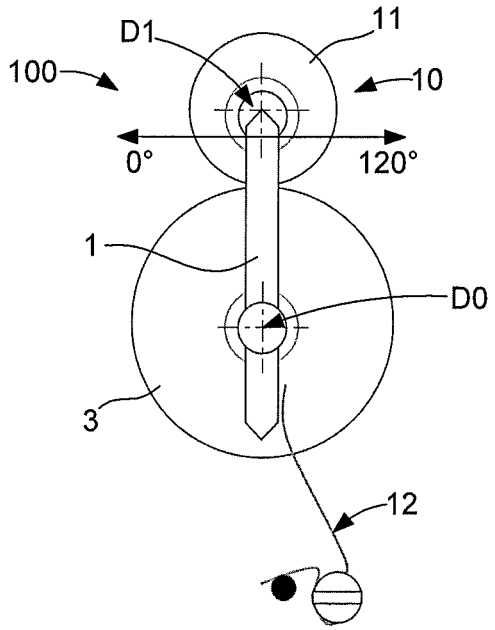
FIGS. 4 to 9 partially illustrate another variant, operating over an angular travel of 120° of the arm, as seen in a plan view in FIG. 4, in FIGS. 5 to 8 which illustrate the positions of the wheel sets at different instants.

According to the invention, third wheel set 3 is arranged to remain in a fixed position during a first basic travel of planetary gear 10, and to make a rotation, and in particular a rapid rotation, always in the same direction, that of anticlockwise arrow B in FIGS. 1 and 2, during a second basic travel of planetary gear 10, under the action of second energy source 22.

In particular, according to the invention, planetary gear 10 is or includes a regulating member 15. The first wheel drives an element of this regulating member 15. More particularly, this regulating member 15 is a tourbillon 150 or a karussel. More particularly still, first wheel 11 drives the cage of this tourbillon 150 or karussel, or forms this cage.

Thus, according to the invention, with respect to fixed structure 110, arm 1 moves in the direction of arrow E under the action of first energy source 12 relative to third wheel set 3 when the latter is idle, whereas, during the return of third wheel set 3 under the action of second energy source 22, arm 1, which is carried by third wheel set 3, moves backwards in the direction of arrow F, with respect to fixed structure 110, during the second basic travel of planetary gear 10.

It is clear that planetary gear 10 permanently rolls around third wheel set 3, and that it continues to rotate with respect to third wheel set 3 during rotation of the latter. There is thus an alternation of first basic travels and second basic travels.

Owing to the successive rotations of the arm in the first direction of travel along arrow E, and in the second, reverse direction along arrow F, axis D1 makes a limited angular travel about main axis D0.

In a particular and non-limiting manner, the first basic travel of planetary gear 10 is very much greater than the second basic travel, notably twenty times greater than the latter.

In the advantageous example illustrated by FIGS. 1 and 2, the complete cycle takes one minute, with fifty-eight seconds of slow speed movement of arm 1 in the first basic travel, and two seconds of rapid return of arm 1 in the first basic travel.

However, the invention makes it possible to modulate differently the ratio between the first part of travel and the second basic travel. It is, for example, possible to envisage obtaining a first basic travel and a second basic travel that are equal.

In the variant of the invention illustrated by FIGS. 1 and 2, in order to manage the rotational motion of third wheel set 3, drive mechanism 100 includes stop means 120, which are fixed to structure 110, and which are more particularly arranged to cooperate with complementary stop means 123 comprised in third wheel set 3 to hold it in position, or comprised in another external wheel set meshing directly or indirectly with third wheel set 3. Stop means 120 more particularly include a release lever, which is arranged to cooperate in succession with pins arranged over wheel set 3, and which form these complementary stop means 123, in the non-limiting example illustrated by FIGS. 1 and 2. In the illustrated example, these pins are angularly arranged in a regular manner. It is nonetheless possible to devise different angular spacings, to create particular displays.

These stop means 120 can be uncoupled, under the action of uncoupling control means 13 comprised in arm 1, when first wheel 11 finishes its first basic travel, to allow pivoting of third wheel set 3 in a single direction (anticlockwise arrow B) under the action of second energy source 22 causing a backward rotation of arm 1 to the start of its angular travel.

When third wheel set 3 is stopped in an angular stop position, first wheel 1 makes a first basic travel, and arm 1 moves in a forward angular travel at a slow speed which is its display speed. At the end of this first basic travel of first wheel 11, uncoupling control means 13 uncouple stop means 120, and third wheel set 3 is then free and subjected to the torque of second energy source 22, directly or via second wheel set 2, according to the chosen variant of construction. Third wheel set 3 then makes a rotation, and more particularly an abrupt and virtually instantaneous rotation, before returning to another angular stop position between another pin 123 and release lever 120. This rotation of third wheel set 3 causes arm 1 to return backwards to its start-of-angular-travel position, and in particular, in the illustrated case, at an accelerated speed which is much higher than its slow display speed.

In another variant, first wheel 11 is arranged to roll inside third wheel set 3. Many other configurations can be envisaged, especially as regards the relative positions of the various pivot axes, with cascades of suitable intermediate wheels.

Naturally, it is also possible to subject third wheel set 3 to the torque of at least a third energy source, for example in a direct mesh.

The operation of drive mechanism 100 is dependent on the level of energy available in second energy source 22. In the case where drive mechanism 100 is integrated in a watch, the second energy source is advantageously recharged by an automatic winding mechanism, not detailed here since it is known to those skilled in the art: first energy source 11 is permanently wound by the second energy source as long as the latter has sufficient energy, this first energy source 11 thus forms a buffer storage device, and the force driving planetary gear 10 by this first energy source 11 is thus a constant force mechanism, or more precisely a constant torque mechanism.

In the very compact variant illustrated by FIGS. 1 and 2, stop means 120 include a lever, which forms a release lever, and which is pivotally mounted on a lever axis D12, and which is returned in the direction of arrow D by elastic return means 127, such as a spring or suchlike. This lever carries a lever pin 129.

Arm 1 includes a ramp 13, which is arranged to cooperate with lever pin 129, at the end of the forward angular travel of arm 1, and to push the lever in the direction of arrow C, which obscures a lever beak having a bearing surface 128, which, until then was holding in position a stop pin 123 comprised in third wheel set 3 (which has three pins at 120° in the present case). Third wheel set 3 is then released, and can rotate, its previously immobilised pin 123 then being able to pass underneath arm 1. The position of pins 123 controls the release function; they ensure the precision and duration of one total period of travel.

Advantageously, arm 1 includes banking means 20, which tend to resist the drive torque of first energy source 12, and which are arranged to limit the rolling speed of first wheel 11. Indeed, anything that can slow down the system is advantageous, to obtain regular operation of the constant force mechanism formed by the invention.

More particularly, these banking means 20 are braking and/or friction and/or regulating means. They can include, in particular, aerodynamic braking means, eddy current braking means, or otherwise. For example, first wheel 11 can carry a seconds hand.

More particularly still, as in the non-limiting case illustrated by FIGS. 1 and 2, banking means 20 are means for regulating the rolling speed of first wheel 11 around third wheel set 3. The regulating mechanism is preferably in planetary gear 10 which forms a planetary wheel set.

As seen in a non-limiting variant illustrated by FIGS. 1 and 2, the means regulating the rolling speed of first wheel 11 about third wheel set 3 include a stop device 17, such as a lever or similar, and which is arranged to cooperate in a discontinuous manner with first wheel 11, or with a synchronous wheel set of first wheel 11, or with a fourth wheel set meshing directly or indirectly with first wheel 11.

In particular and as seen in FIGS. 1 and 2, the second pivot axis D2 is parallel to main pivot axis D0 and distinct therefrom.

In particular, and as seen in FIGS. 1 and 2, third wheel set 3 is arranged to pivot about main axis D0.

More particularly, planetary gear 10 forms all or part of banking means 20 and is a regulating member 15.

More particularly, regulating member 15 includes at least one inertia mass 1700 subjected to an alternating pivoting motion by pallets 170, comprised in stop device 17, and which is arranged to cooperate with a ratchet 18 driven directly or indirectly by first wheel 11.

More particularly, ratchet 18 is coaxial to first wheel 11.

More particularly, ratchet 18 is an escape wheel.

In a particular embodiment, regulating member 15 is a tourbillon 150 and first wheel 11 drives the cage of tourbillon 150, or forms the cage of tourbillon 150. In this case, the axis of the resonator mechanism, typically a balance/balance spring, comprised in regulating member 15, coincides with first pivot axis D1.

In another similar particular embodiment, regulating member 15 is a karussel, and first wheel 11 drives the karussel cage or forms the karussel cage. In such case, the axis of the resonator mechanism, typically a balance/balance spring, comprised in regulating member 15, is a secondary pivot axis, parallel to first pivot axis D1, for example located at the distal end of a governor 19, as illustrated in FIGS. 1 and 2.

More particularly, regulating member 15, be it tourbillon or karussel or otherwise, includes such a governor 19, which is driven directly or indirectly by first wheel 1.

More particularly, this governor 19 is synchronous with first wheel 11, and is able to form a first display of a first time magnitude.

More particularly still, governor 19 is a tourbillon or karussel cage.

Each wheel set of the drive mechanism according to the invention can be used for a particular display. Thus, more particularly, arm 1 forms or drives a display of a second time magnitude. This arm can carry off-centre displays, for example on stars pivotally mounted on arm 1.

Likewise, more particularly, third wheel set 3 forms or drives a display of a third time magnitude, for example a jumping minute display.

More particularly, second wheel set 2 forms or drives a power reserve display.

It is clear that the drive mechanism according to the invention makes possible a very lively display of the passage of time, through the clearly visible rolling of first wheel 11 on third wheel set 3, and by the periodic backward return of arm 1. Each wheel set can be used to carry an off-centre display.

The invention also concerns a timepiece movement including at least one such drive mechanism 100.

The invention also concerns a timepiece 1000 including at least one such drive mechanism 100 and which, in a first variant, is a watch. It first energy source 12 and/or its second energy source 22 can include, in a conventional manner, at least one barrel and/or an electromechanical energy source or otherwise. Advantageously, second energy source 22 is recharged by an automatic winding mechanism.

In another variant, timepiece 1000 is static, and may, in particular, be a clock. It first energy source 12 and/or its second energy source 22 can include, in a conventional manner, at least one barrel and/or an electromechanical energy source or otherwise. Or its first energy source 12 and/or its second energy source 22 includes at least one weight, and this timepiece 1000 then includes means for winding each weight. However, preferably, first energy source 12 is a barrel forming a buffer storage device, which means that it is only necessary to wind second energy source 22, which powers first energy source 12.

Figure 5:
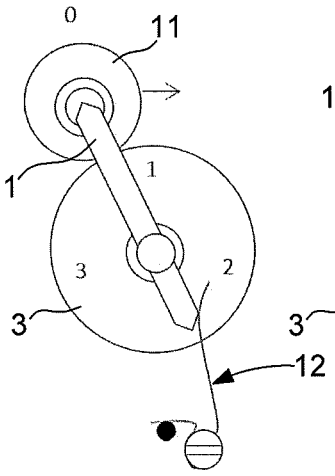
Figure 6:
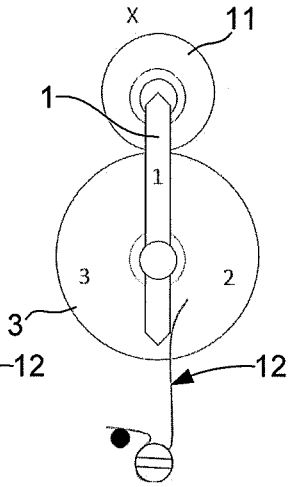
Figure 7:
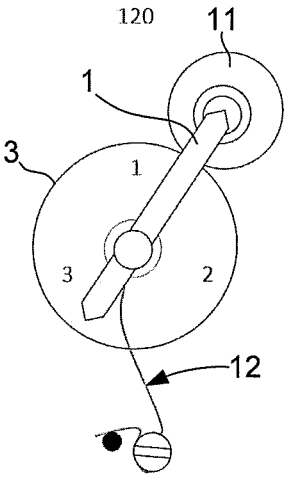
Figure 8:
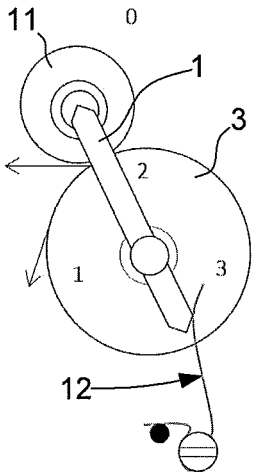
Figure 9:
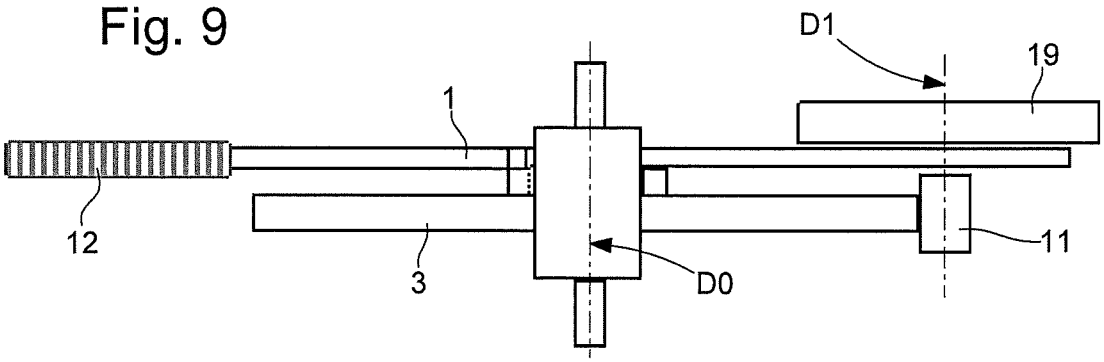

The principle of the invention is applicable to many other variants, and to numerous particular applications. This principle is illustrated, in a simplified manner in comparison to FIGS. 1 and 2, by FIGS. 4 to 9, which show only first energy source 12, illustrated in the form of a simple flat spring, arm 1 carrying first wheel 11 and third wheel set 3 on which first wheel 11 rotates. In this example, a tourbillon cage, carried by first wheel 11, makes one revolution per minute, first wheel 11 moves over third wheel set 3 for around 18 seconds when third wheel set 3 is still in a stationary position, and continues to roll over this third wheel set for the two seconds required for third wheel set 3 to return backwards 120° in the anticlockwise direction in these Figures. FIG. 5 shows the assembly in position immediately after such a backward return; FIG. 6 shows an intermediate position X; FIG. 7 shows the extreme angular position of the clockwise travel of arm 1, and FIG. 8 illustrates the backward return anticlockwise of the third wheel set (illustrated by the change of position of references 1, 2, 3) and of arm 1 which it carries.

Figure 10:
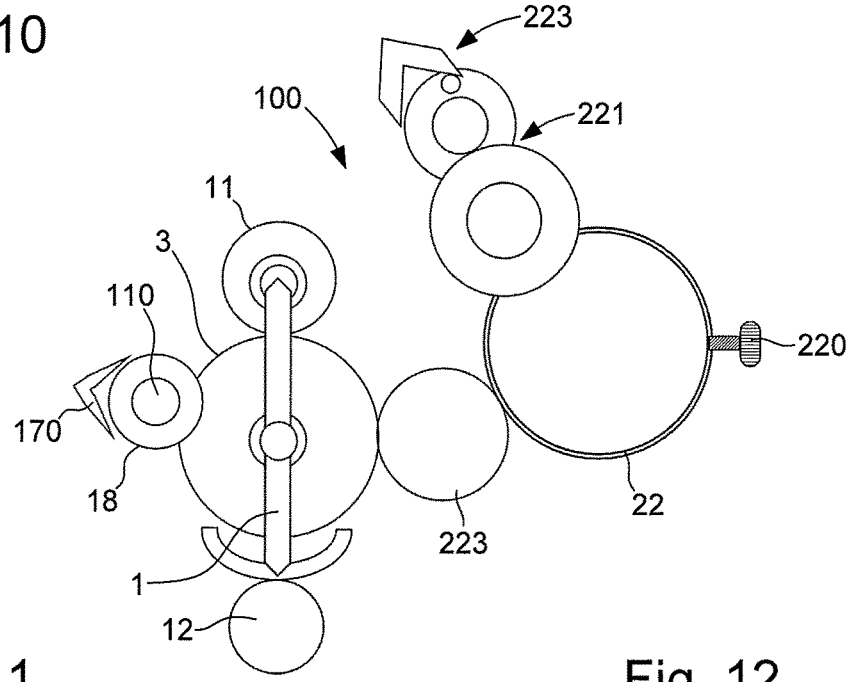
FIG. 10 represents a schematic, plan view of yet another variant of the mechanism according to the invention.

FIG. 10 illustrates yet another variant, with an arm 1 acting as winding rack on a winding barrel of the arm of the cage, forming first energy source 12, which drives cage arm 1; under the effect of its torque, the tourbillon cage is driven and makes its rotation on the circumference of third wheel set 3, arm 1 moves as a function of frequency and gear ratio. Arm 1 driving the cage moves from its first position of 0° and reaches its maximum position of 120°. At this instant, unlocking of second energy source 22 occurs, formed here by the barrel of a basic watch movement. This barrel is linked to a reduction wheel set 223, and the latter is connected to third wheel set 3. The force from movement barrel 22 will drive reduction wheel set 223 and consequently drive third wheel set 3 in a 120° rotation anticlockwise. The displacement in degrees of third wheel set 3 is controlled via a gear train 221 and positioned by a stop pin on a position bolt 223, this train 221 can be connected either to the reduction wheel set 223, or to the movement barrel 22. To manage the return over a duration of around 2 seconds, a governor with a reverser, notably including a pinion, a ratchet 18, a lever 170, is in series with third wheel set 3, and makes it possible to adjust the backward return duration, notably comprised between 1 and 10 seconds. During the 120° displacement of third wheel set 3, first energy source 12, which is the cage arm spring here, is wound again, the cage continues to operate by moving over the circumference of third wheel set 3. The variant of FIG. 10 controls the angular travel otherwise than by the pins 123 of the variant of FIGS. 1 and 2, which position train 221 replaces here. It is possible here to manage other angular values, for example 360°, to display a date change or otherwise.

It is noted that the barrel spring of the basic movement no longer interferes with the going train as in a conventional movement. Its only function now is to impart the impulse necessary to position third wheel set 3.

First energy source 12, which is the cage arm spring here, is preloaded with the torque necessary for operation of the tourbillon, this force will remain constant. The 120° angular, anticlockwise, rotational travel of third wheel set 3 winds the cage arm spring in a regular manner.

Figure 11:
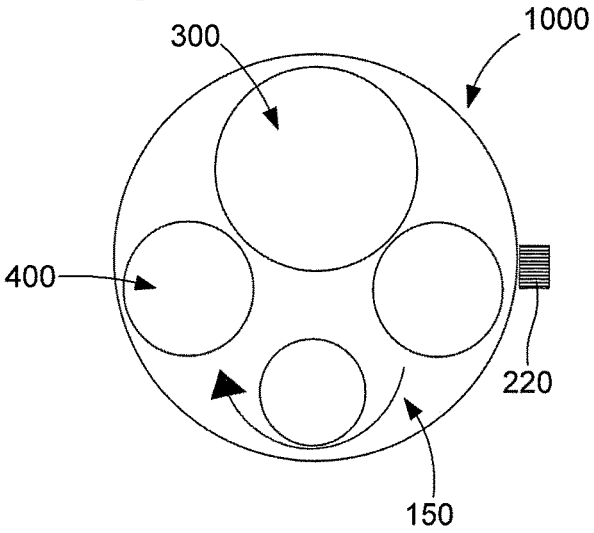
FIGS. 11 to 14 represent plan views of different arrangements of the mechanism according to the invention in a watch.
Figure 12:
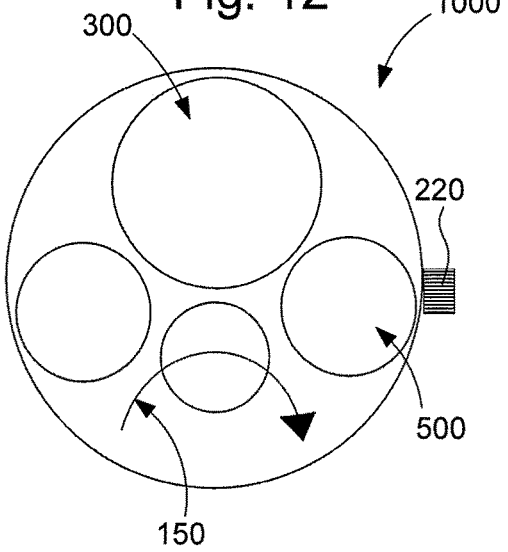
Figure 13:
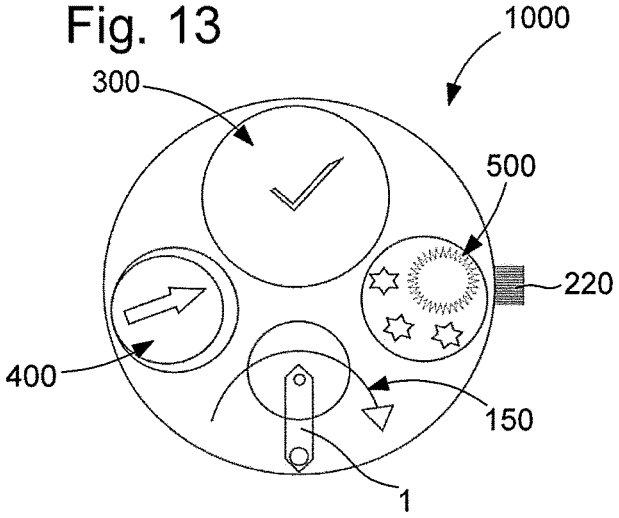
Figure 14:
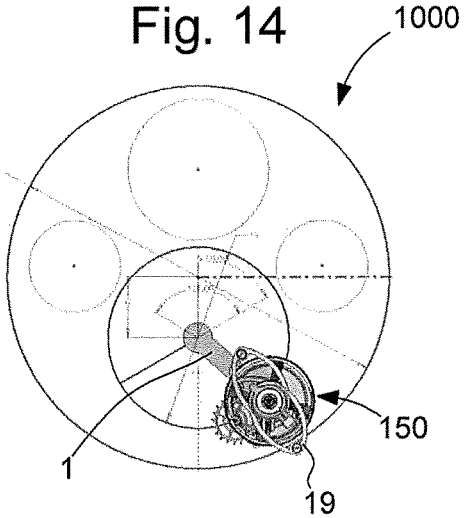

In this manner, it is possible to envisage developing several types of movement of the hour and minute hands, and complications like the moon and/or day/night and/or power reserve indications, as seen in FIGS. 11 to 13, in particular, on the return of the cage and the third wheel set, or with the position train where it is no longer necessary to use a cannon-pinion, and where the time-setting function is one-directional; or with the position train; with the position train and/or movement barrel the time-setting function is possible in both direction. Winding occurs via crown 220, main barrel 22 will no longer interact with the going train as in the usual technique.

This arrangement also makes it possible to perform the moon correction directly using the crown, it is no longer necessary to incorporate a corrector integrated in the case middle.

It is clear that the invention ensures a virtually constant drive force for the regulating mechanism, notably a tourbillon or karussel cage, throughout the entire power reserve of the main barrel.

FIGS. 11 to 14 illustrate the broad scope offered by the invention for the positioning of the various displays. In the illustrated example, the hours and minutes are read on a dial at 12 o'clock, the power reserve on a sector with a retrograde hand at 9 o'clock, the moon and/or day/night, or sunset or other indications at 3 o'clock, while the tourbillon has a movement over 120°, and it is possible to orient the movement of the cage over 120° in a substantially peripheral motion as in FIGS. 11 and 14, or in a motion about an axis as far off-centre as possible, as in FIGS. 12 and 13, with a backward movement of the cage respectively from left to right, or from right to left.

The value of 120° used for the examples is not restrictive, the angular value depends on the desired time travel duration; the backward travel value is also adjustable, for example between 2 and 5 seconds, and allows a non-abrupt, shock-free, backward return to be obtained.

The backward return of the cage makes it possible to power the change of minutes The backward return is not linked to the frequency of the resonator mechanism and has no effect on the rate of the movement.

In other variants, it is possible to provide the third wheel set with several planetary gears 10 on its periphery. It is also possible to devise a system on several levels to manage distinct functions.

The invention claimed is:

1. A timepiece drive mechanism comprising a fixed structure on which is pivotally mounted, about a main axis, an arm carrying a planetary gear, which is pivotally mounted on said arm about a first pivot axis remote from said main axis and includes a first wheel pivotally mounted about said first pivot axis or a secondary pivot axis that is parallel thereto, said arm being subjected to the return torque of a first energy source, said drive mechanism further including at least a second energy source arranged to subject to a return torque a third wheel set comprised in said drive mechanism, directly or indirectly via a second wheel set pivotally mounted about a second pivot axis, said first wheel being arranged to roll, under the action of said first energy source, over said third wheel set in a regular forward rolling motion with respect to said structure in a single direction of rotation, wherein said third wheel set is arranged to remain in a fixed position during a first basic travel of said planetary gear and, under the action of said second energy source, to make a rotation in only one direction during a second basic travel of said planetary gear, during which said arm, which is carried by said third wheel set, moves backwards with respect to said fixed structure, and wherein said drive mechanism includes stop means arranged to cooperate with complementary stop means comprised in said third wheel set, or comprised in another external wheel set meshing directly or indirectly with said third wheel set, to hold the latter in position, said stop means being uncouplable under the action of uncoupling control means, comprised in said arm when said arm reaches the end of its forward angular travel, to allow pivoting of said third wheel set in a single direction under the action of said second energy source causing a backward rotation of said arm to the start of its said angular travel.

2. The drive mechanism according to claim 1, wherein said arm comprises banking means tending to resist the drive torque of said first energy source and arranged to limit the rolling speed of said first wheel.

3. The drive mechanism according to claim 2, wherein said banking means are braking means and/or friction means and/or regulating means.

4. The drive mechanism according to claim 3, wherein said banking means are means for regulating the rolling speed of said first wheel about said third wheel set.

5. The drive mechanism according to claim 4, wherein said means regulating the rolling speed of said first wheel about said third wheel set include a stop device arranged to cooperate in a discontinuous manner with said first wheel or with a fourth wheel set meshing directly or indirectly with said first wheel.

6. The drive mechanism according to claim 2, wherein said planetary gear forms all or part of said banking means and is a regulating member.

7. The drive mechanism according to claim 6, wherein said regulating member includes a resonator mechanism with at least one inertia mass subjected to a pivoting alternating motion by a lever cooperating with a ratchet driven directly or indirectly by said first wheel.

8. The drive mechanism according to claim 7, wherein said ratchet is coaxial to said first wheel.

9. The drive mechanism according to claim 6, wherein said regulating member is a tourbillon or karussel and wherein said first wheel drives the cage of said tourbillon or karussel or forms the cage of said tourbillon or karussel.

10. The drive mechanism according to claim 6, wherein said regulating member is a karussel and wherein said first wheel drives the cage of said karussel or forms the cage of said karussel.

11. The drive mechanism according to claim 6, wherein regulating member includes a governor driven directly or indirectly by said first wheel.

12. The drive mechanism according to claim 11, wherein said governor is synchronous with said first wheel and forms a first display of a first time magnitude.

13. The drive mechanism according to claim 11, wherein said governor is a tourbillon or karussel cage.

14. The drive mechanism according to claim 1, wherein said second pivot axis is parallel to said main axis and distinct therefrom.

15. The drive mechanism according to claim 1, wherein said third wheel set is arranged to pivot about said main axis.

16. The drive mechanism according to claim 1, wherein said arm forms or drives a display of a second time magnitude.

17. The drive mechanism according to claim 1, wherein said third wheel set forms or drives a display of a third time magnitude.

18. The drive mechanism according to claim 1, wherein said second wheel set forms or drives a power reserve display.

19. A timepiece comprising at least one drive mechanism according to claim 1.

20. The timepiece according to claim 19, wherein said timepiece is a watch.

21. The timepiece according to claim 20, wherein said first energy source and/or said second energy source is a barrel.

22. The timepiece according to claim 19, wherein said timepiece is a clock.

23. The timepiece according to claim 22, wherein said first energy source and/or said second energy source includes at least one weight, and wherein said timepiece includes means for winding each said weight.

* * * * *